United States Patent [19]

Takamura

[11] Patent Number: 4,739,605

[45] Date of Patent: Apr. 26, 1988

[54] METHOD AND DEVICE FOR BARREL-BINDING AND PACKAGING ARTICLES

[75] Inventor: Yoshiyuki Takamura, Nagoya, Japan

[73] Assignee: Fuji Pack System Ltd., Nagoya, Japan

[21] Appl. No.: 876,064

[22] Filed: Jun. 19, 1986

[51] Int. Cl.[4] ..... B65B 13/02

[52] U.S. Cl. ..... 53/399; 53/586

[58] Field of Search ..... 53/210, 229, 399, 466, 53/580, 582, 586, 589, 590

[56] References Cited

U.S. PATENT DOCUMENTS

| | | | |
|---|---|---|---|
| 3,552,091 | 1/1971 | Johnson et al. | 53/586 |
| 4,263,712 | 4/1981 | Schroeder | 53/466 X |
| 4,316,760 | 2/1982 | Satomi | 53/586 X |
| 4,423,584 | 1/1984 | Elsner et al. | 53/229 X |
| 4,559,766 | 12/1985 | Matsushita | 53/586 |
| 4,570,422 | 2/1986 | Watanabe | 53/586 X |
| 4,662,148 | 5/1987 | Nilsson | 53/586 X |

*Primary Examiner*—Robert L. Spruill
*Assistant Examiner*—Steven P. Weihrouch
*Attorney, Agent, or Firm*—Jordan and Hamburg

[57] ABSTRACT

In a method and device for barrel-binding and packaging articles, a first end of packaging material is pinched between a fixed seal member and a first pinching member movable with respect to the fixed seal member. The first end and a coupling end of the packaging material is pinched between the fixed seal member and a movable seal member confronting the fixed seal member with the articles bound by the packaging material. The coupling end is then pinched between the first pinching member and a second pinching member and a pushing-in member is inserted between the fixed seal member and the first pinching member in response to separation of the first pinching member for pinching the first and coupling ends. The first and coupling ends of the packaging material are then joined between the fixed and movable seal members while they are pinched between the seal members and thereafter the coupling end is cut by a cutting blade at the inserted end of the pushing-in member. The fixed and movable seal members and the first and second pinching members are separated from each other individually, and the pushing-in member is pulled from between the fixed seal member and the first pinching member, to again pinch a first end of the packaging material between the fixed seal and pinching members.

14 Claims, 13 Drawing Sheets

METHOD AND DEVICE FOR BARREL-BINDING AND PACKAGING ARTICLES

BACKGROUND OF THE INVENTION

1. Field of the Invention

This invention relates to a barrel-binding method and device for packaging articles by the use of packaging material, such as packaging film or binding tape.

2. Description of the Related Art

In barrel-binding and packaging articles by the use, for example, of packaging film, the articles are bound by a packaging film and both end portions of the packaging film are pinched and joined together by seal members. However, if some looseness exists between the articles and the packaging film wound round the articles, some articles tend to slip out through either opened portion of the wound packaging film; thus, the packaged condition is poor.

Further, in pinching and joining together both end portions of the packaging film by the use of the seal members to thereby tighten the packaging film against the articles, one out of the articles tends to be raised toward the seal members if there are many articles, or deformed toward the seal members if the articles are of soft substance, thereby resulting in a fear that the articles or packaging film will eat into the seal members; thus, the articles or packaging film can be damaged and the packaged condition can become defective.

Furthermore, it was impossible to package successively and efficiently articles by the use of a packaging film being pulled out from a take-up roll.

SUMMARY OF THE INVENTION

It is an object of the present invention to provide a method and a device for barrel-binding and packaging articles which are capable of eliminating looseness between articles and packaging material wound round the articles and tightly binding the articles surely, thus obviating a fear that the articles will slip down through the packaging material and realizing a good packaged condition.

It is another object of the present invention to provide a method and a device for barrel-binding and packaging articles which are capable of obviating a fear that articles or packaging material will eat into seal members and preventing articles or packaging material from being damaged, thus realizing a good packaged condition.

It is still another object of the present invention to provide a method and a device for barrel-binding and packaging articles which are capable of packaging successively and efficiently articles by the use of packaging material being pulled out from a take-up roll.

Other objects of the present invention will become apparent upon understanding the embodiments hereinafter described and will be indicated clearly in the appended claims. Various advantages not referred to herein will occur to those skilled in the art upon practicing the present invention.

DETAILED DESCRIPTION OF THE PREFERRED EMBODIMENTS

An embodiment for barrel-binding and packaging articles by the use of packaging film, which embodies a method and a device according to the present invention, will now be described with reference to the drawings.

Figure 1:
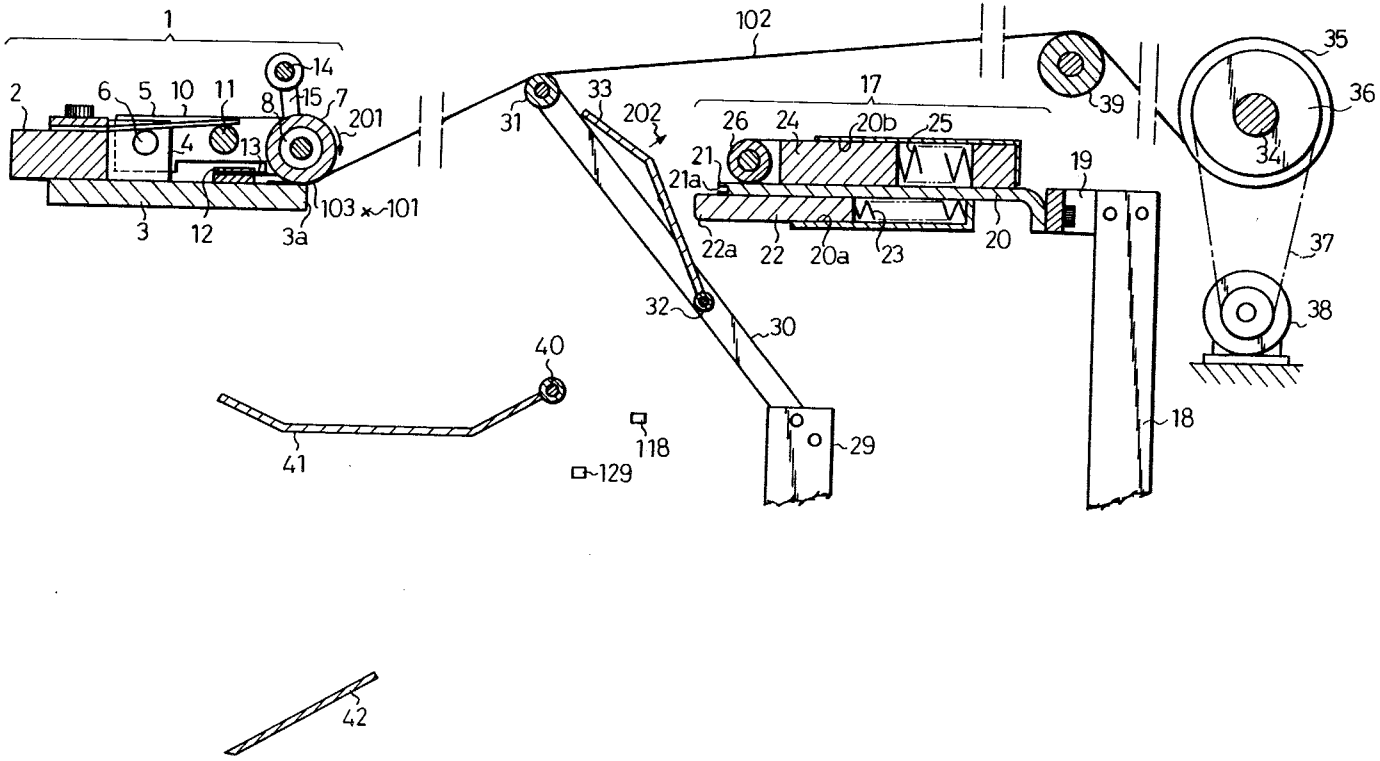
FIG. 1 is a schematic sectional view showing the initial state of operation of a device for barrel-binding and packaging articles.
Figure 2:
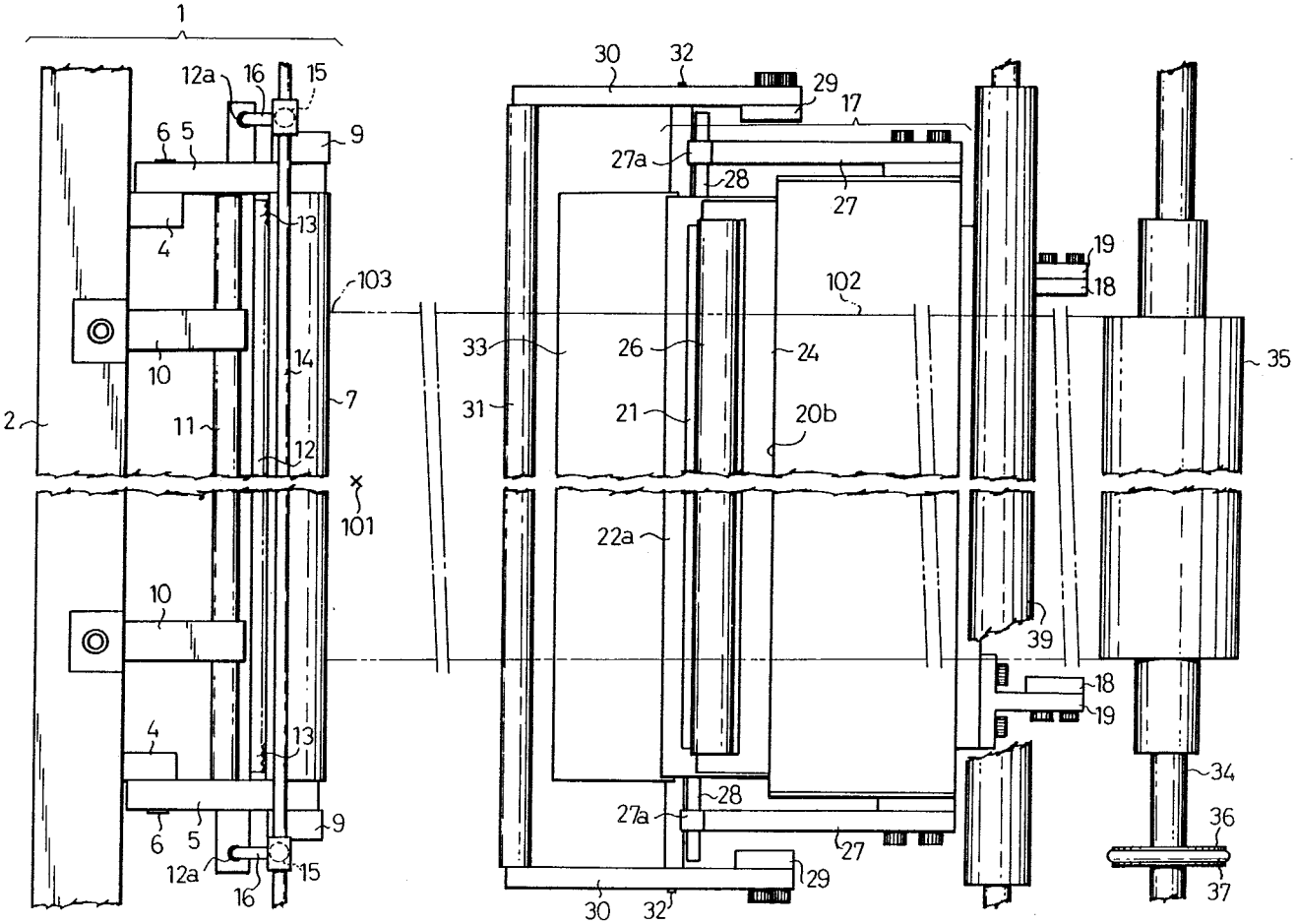
FIG. 2 is a schematic plan view corresponding to that of FIG. 1.
Figure 8:
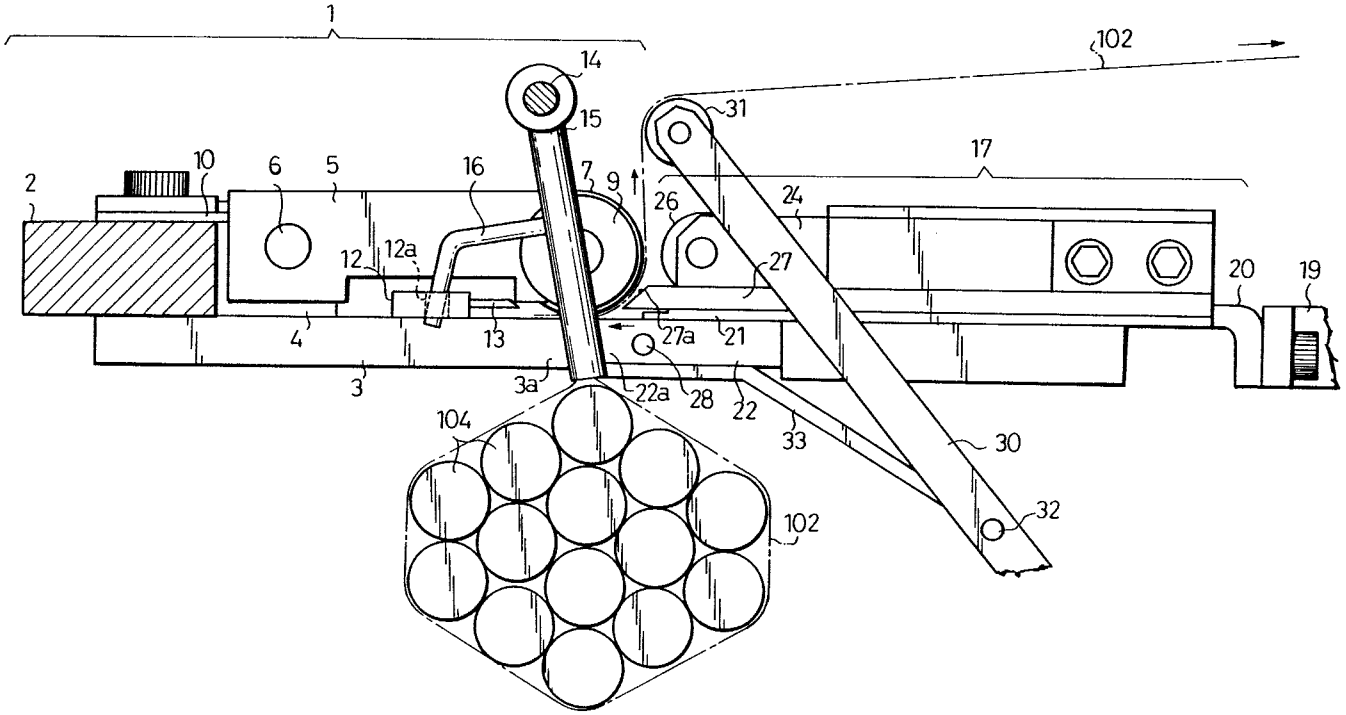
FIG. 8 is a fragmentary enlarged side view corresponding to that of FIG. 6.
Figure 9:
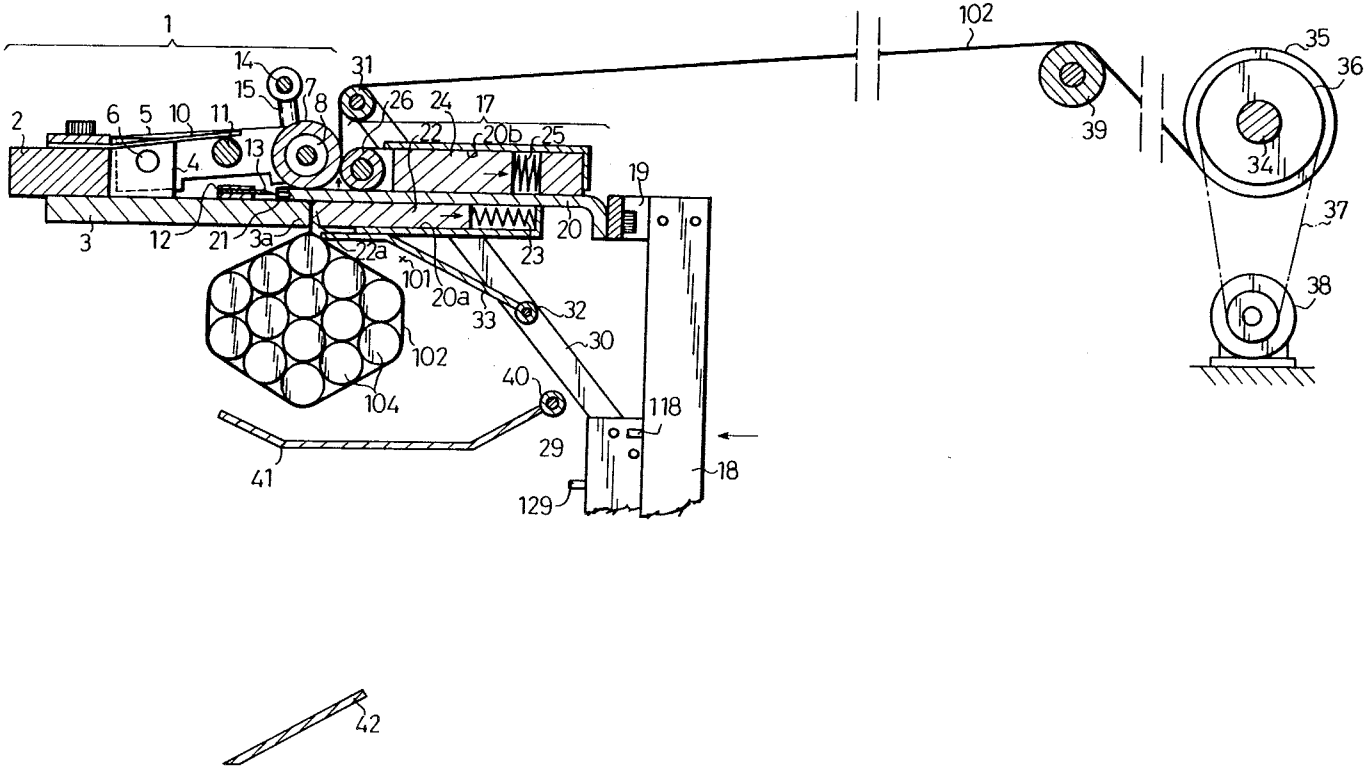
Figure 10:
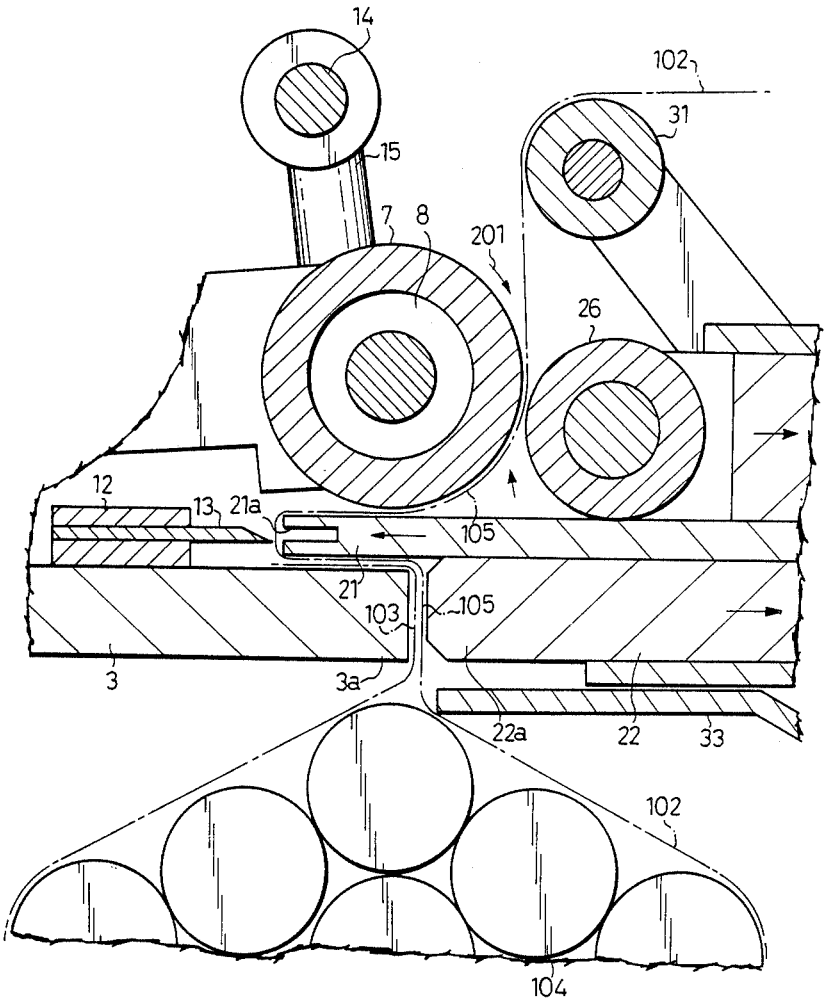
FIG. 10 is a fragmentary enlarged sectional view corresponding to that of FIG. 9.
Figure 11:
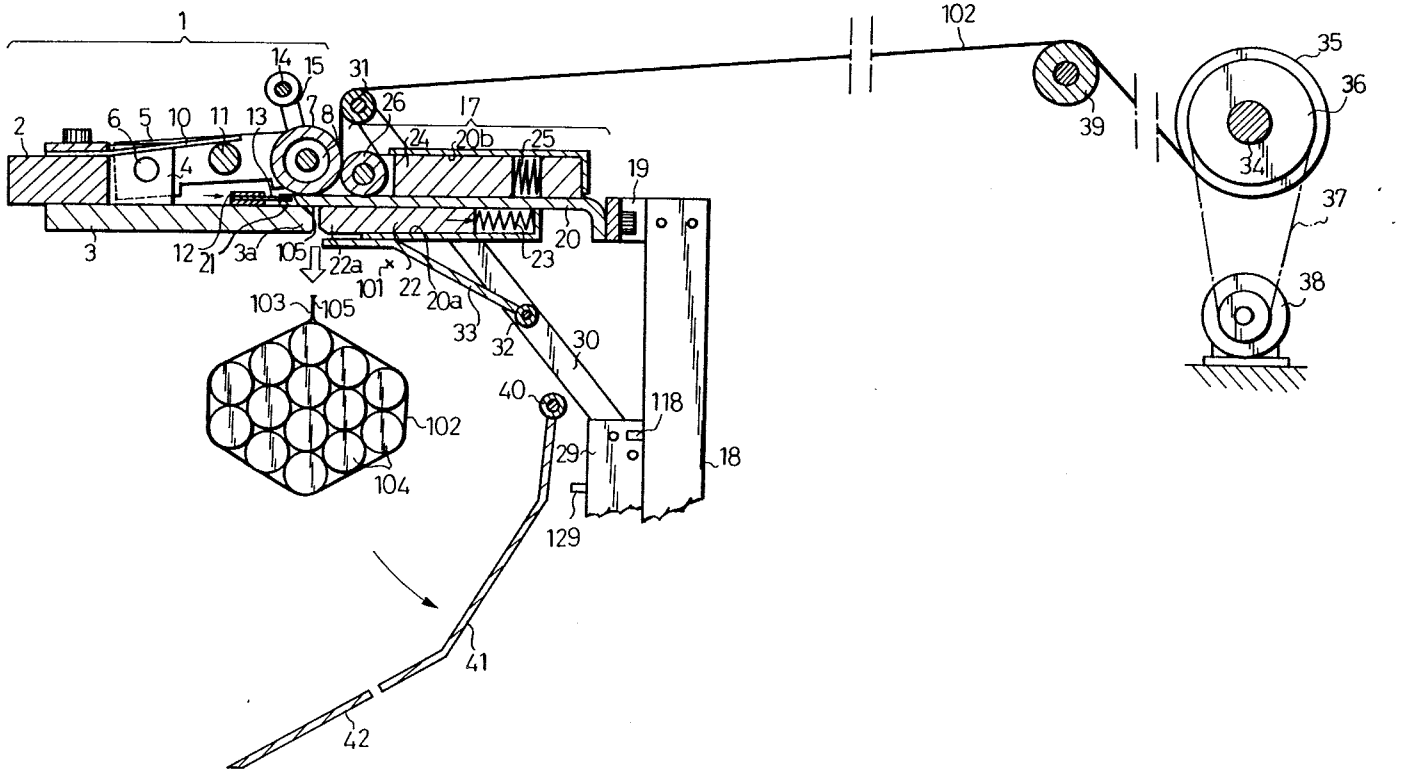
Figure 12:
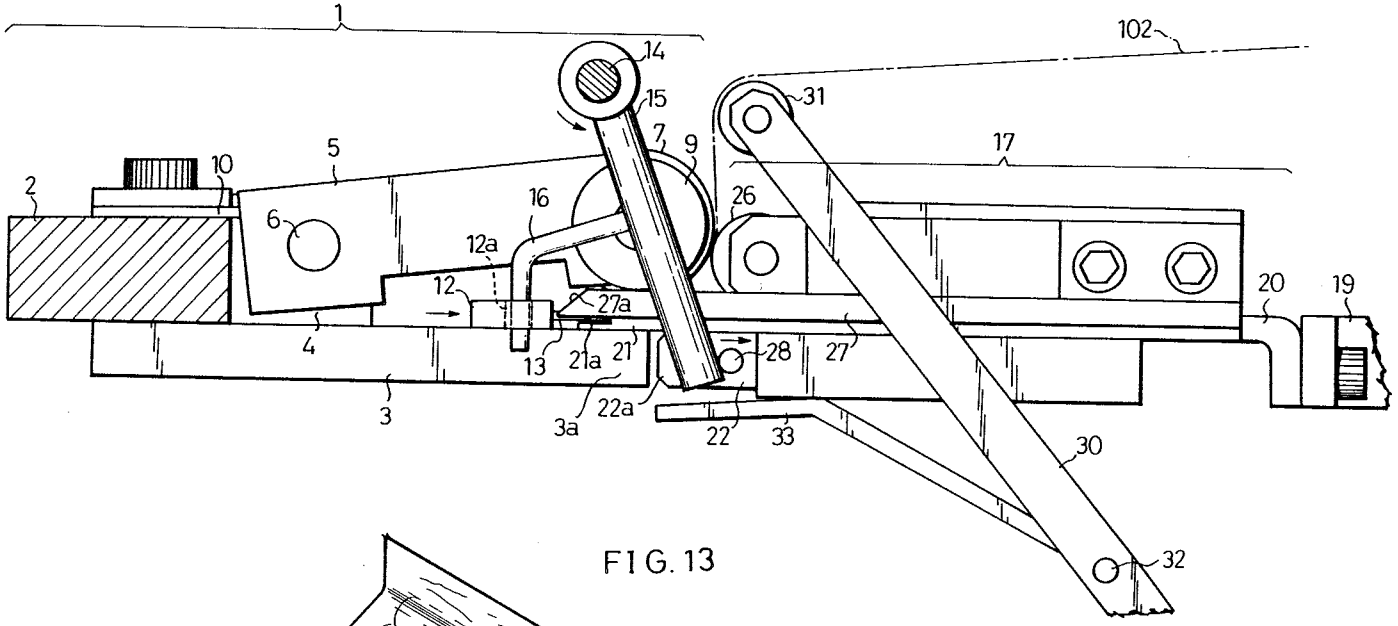
FIG. 12 is a fragmentary enlarged side view corresponding to that of FIG. 11.
Figure 14:
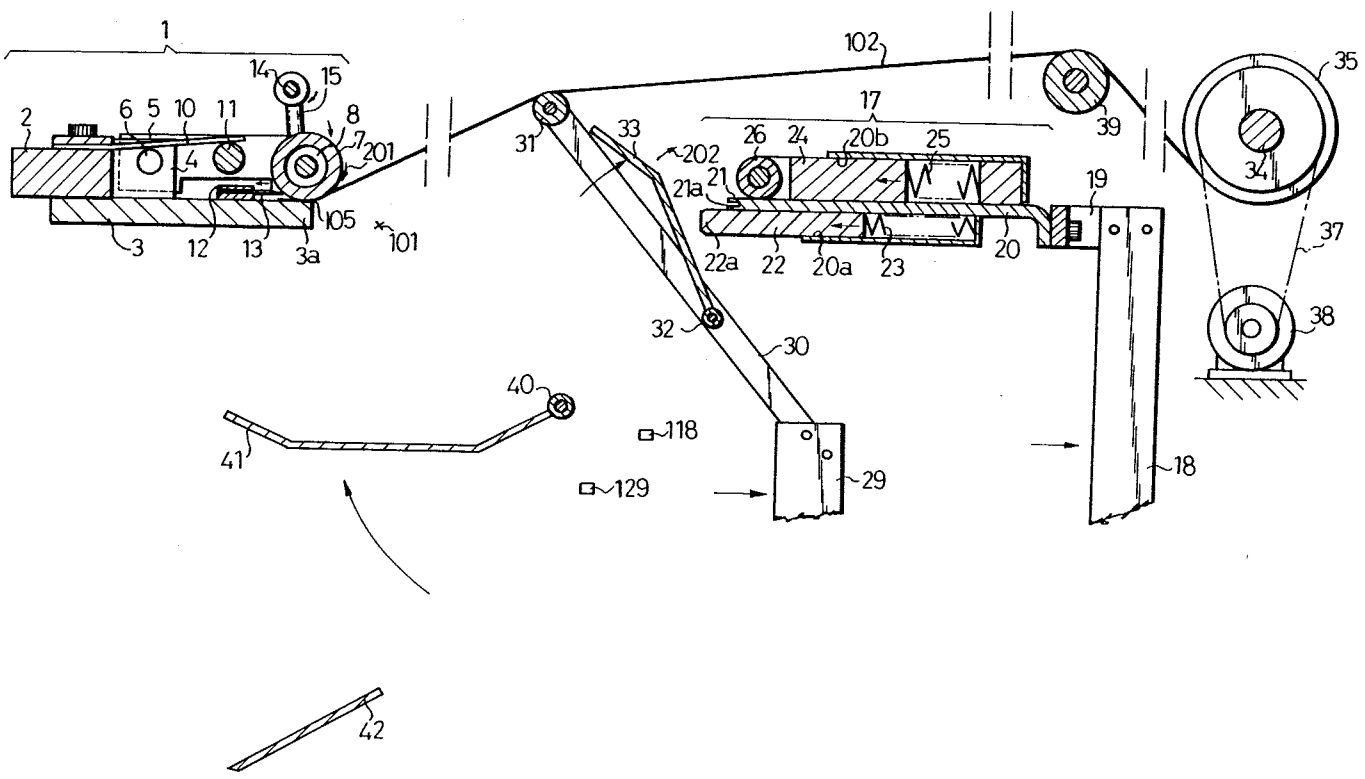
FIG. 14 is a schematic sectional view showing the state of the device after completion of packaging.

Referring to a fixed-side seal cutting assembly 1 shown in FIGS. 1 and 2 which is standing in the initial state of operation, a fixed seal plate 3 equipped with a heater is secured on the under side of a fixed base 2, and the point of the seal plate 3 facing a packaging station 101 forms a pinching portion 3*a*. A pair of arms 5 is supported by supporting portions 4 projecting on the laterally-spaced sides of the fixed base 2 via support shafts 6 so as to tilt vertically above the fixed seal plate 3, a fixed-side pinching roller 7 is supported between the points of the two arms 5 via a one-way clutch 8 so as to rotate only in the direction of the arrow 201 of FIG. 1, and coupling rollers 9 are supported on the respective outsides of the arms 5. Leaf springs 10 are secured to the laterally-spaced sides of the fixed base 2 and engaged with a coupling lever 11 stretched between the two arms 5 at a position between the fixed base 2 and the pinching roller 7. By the urging force of leaf springs 10 against the coupling lever 11, the pinching roller 7 is always in contact with the pinching portion 3*a* of the fixed seal plate 3. A slide plate 12 is placed on the fixed seal plate 3 between it and the pinching roller 7, and a saw blade 13 attached to the slide plate 12 along the pinching roller 7 is confronted with an abutting station between the fixed plate 3 and the pinching roller 7. Both laterally-spaced ends of the slide plate 12 project outward beyond the respective arms 5, each end having a hole 12*a*. A rotary shaft 14 stretched above the pinching roller 7 has rods 15 extending downward on the respective outsides of the arms 5 as shown in FIGS. 2 and 8, and an angle lever 16 secured to each rod 15 is fitted in the hole 12*a* of the corresponding slide plate 12. As the rods 15 tilt in response to rotation of the rotary shaft 14 as shown in FIGS. 11, 12, and 14, the slide plate 12 and the saw blade 13 move on the fixed seal plate 3 via the angle levers 16 so as to approach and separate from the pinching roller 7.

Referring to a movable-side seal cutting assembly 17 shown in FIGS. 1 and 2 which is standing in the initial state of operation, a base plate 20 is secured via brackets 19 to the upper ends of laterally-spaced movable levers 18 of a pair, the point of the base plate 20 facing the packaging station 101 forms a pushing-in portion 21, and this pushing-in portion 21 has a laterally-extending cutting groove 21*a*. A movable seal plate 22 is supported in a lower accommodation chamber 20*a* of the base plate 20 and urged by a compression coil spring 23 so as to move toward the packaging station 101, and the point of the movable seal plate 22 adjacent to the pushing-in portion 21 of the base plate 20 forms a pinching portion 22*a*. A supporting plate 24 is supported in an upper accommodation chamber 20*b* of the base plate 20 and urged by a compression coil spring 25 so as to move toward the packaging station 101, and the point of the supporting plate 24 adjacent to the pushing-in portion 21 of the base plate 20 supports a movable-side pinching roller 26. As will be seen, the pinching portion 22*a* of the movable seal plate 22 projects toward the packaging station 101 far more than either the pushing-in portion 21 of the base plate 20 or the movable-side pinching roller 26. Guide levers 27 are provided on the laterally-spaced sides of the base plate 20 projecting toward the packaging station 101, and as shown in FIG. 8, the point of each guide lever 27 adjacent to the pushing-in portion 21 of the base plate 20 has an inclined coupling surface 27*a*. The laterally-spaced sides of the movable seal plate 22 have respective coupling pins 28 projecting closely to the pinching portion 22*a*.

Between the movable-side seal cutting assembly 17 and the fixed-side seal cutting assembly 1 thus configured, a pair of supporting levers 30 is secured with some inclination toward the packaging station 101 to the upper ends of laterally-spaced movable levers 29 of a pair disposed below the movable-side seal cutting assembly 17 standing in the initial state of operation shown in FIG. 1, and a guide roller 31 is stretched between the upper ends of both supporting levers 30 above the movable-side seal cutting assembly 17. An angular presser plate 33 is supported pivotably by a support shaft 32 stretched between the supporting levers 30 below the movable-side seal cutting assembly 17, and urged by a spring (not shown) in the direction of the arrow 202 of FIG. 1 so that it is close to the movable-side seal cutting assembly 17.

A film take-up roll 35 is attached to an attaching shaft 34 stretched oblique above the movable-side seal cutting assembly 17, and a pulley 36 secured to the attaching shaft 34 is interlinked through a belt 37 with a reversible electric motor 38. A packaging film 102 pulled out from the take-up roll 35 is guided by an intermediate roller 39 and the guide roller 31 so as to pass above the movable-side seal cutting assembly 17 in the initial state of operation shown in FIG. 1, and its one end 103 is held in the fixed-side seal cutting assembly 1, or between the pinching portion 3*a* of the fixed seal plate 3 and the fixed-side pinching roller 7. Since this fixed-side pinching roller 7 is supported by means of the one-way clutch 8, it cannot rotate in the direction of the film end 103 being pulled out (in the direction opposite to that of the arrow 201) and the end 103 is surely held.

A receiving plate 41 is supported by a rotary shaft 40 stretched below the packaging station 101 and tilted upward above an ejecting plate 42 in the initial position of operation shown in FIG. 1. And, this receiving plate 41 tilts upward and downward in response to rotation of the rotary shaft 40 as shown in FIGS. 11 and 14.

The two sets of movable levers 18 and 29 are interlinked at their lower ends with a disc cam (not shown) and can come close to the fixed-side seal cutting assembly 1 until either the movable levers 29 abut on stoppers 129 or the movable levers 18 abut on stoppers 118, and thereafter, they can again move back up to the respective initial positions of operation shown in FIG. 1. The rotary shaft 14 of the fixed-side seal cutting assembly 1 and the rotary shaft 40 of the receiving plate 41 are also rotatable in interlinked relation with the disc cam. The electric motor 38 is energized so as to rotate forward and backward by means of limit switches (not shown) which are changed over in response to rotation of the disc cam.

Figure 3:
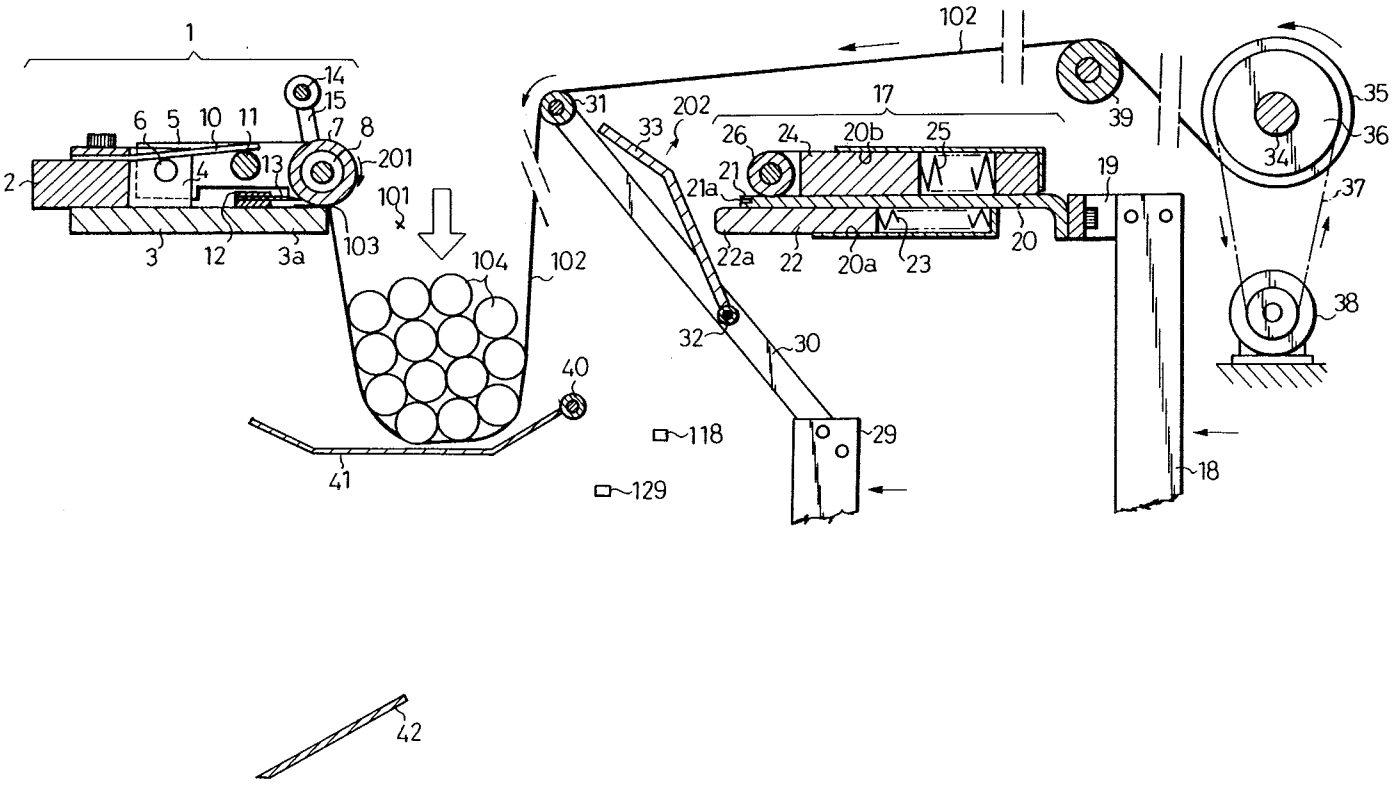
FIGS. 3, 4, 5, 6, 9, and 11 are schematic sectional views showing the sequence of packaging action of the device.

In the initial state of operation shown in FIG. 1, first, the electric motor 38 is energized so as to rotate forward for a time interval set in a timer, as a result, a desired length of packaging film 102 compatible with articles 104 is pulled out from the take-up roll 35. The packaging film 102 hangs down between the fixed-side seal cutting assembly 1 and the guide roller 31 into the form of a concavity, and then the articles 104 are thrown into this concave section. Then, as both the movable levers 18 and 19 move so as to approach the fixed-side seal cutting assembly 1 as shown in FIG. 3, the movable-side seal cutting assembly 17, guide roller 31, and presser plate 33 also move.

Figure 4:
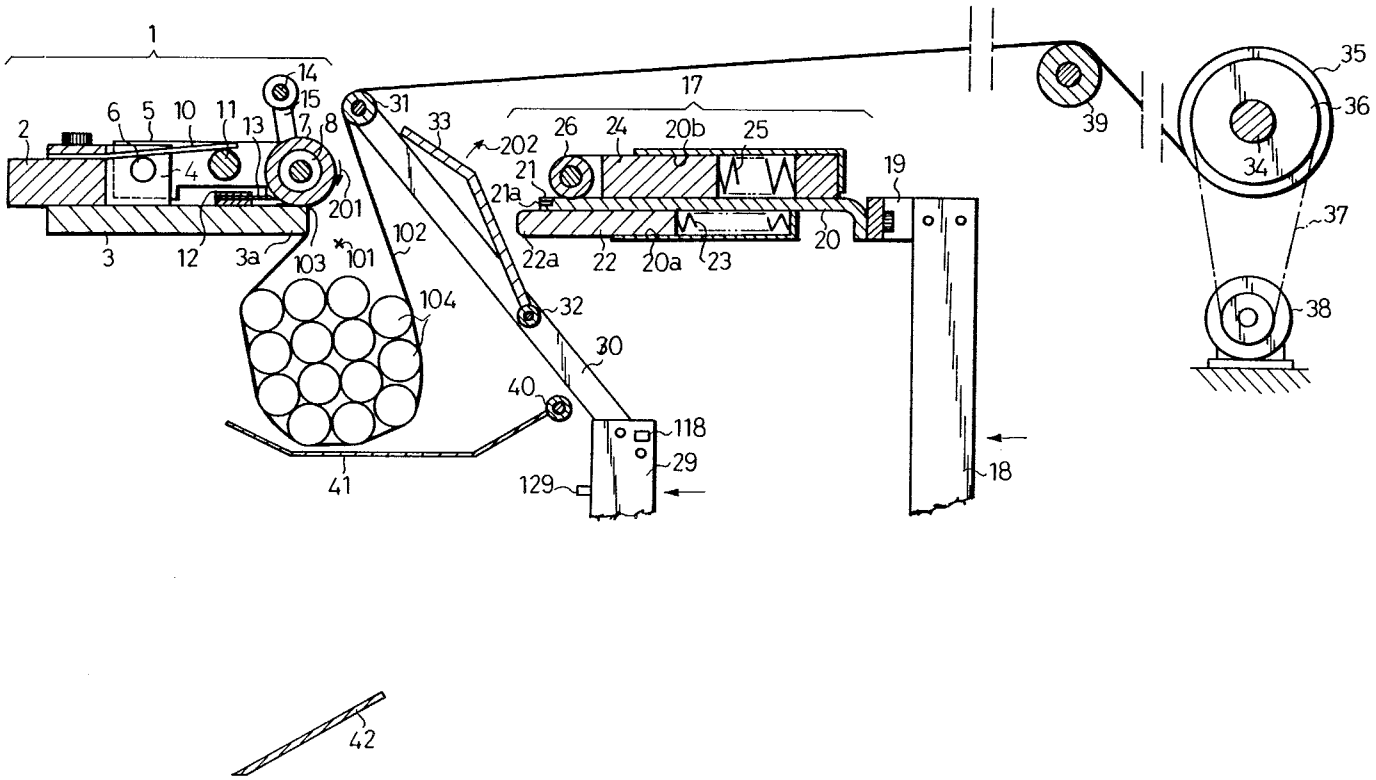

As both the movable levers 18 and 29 move further, one set of movable levers 29 only abut on the stoppers 129 as shown in FIG. 4, so that the guide roller 31 and the presser plate 33 come close to the fixed-side pinching roller 7 of the fixed-side seal cutting assembly 1 and stop there.

Figure 5:
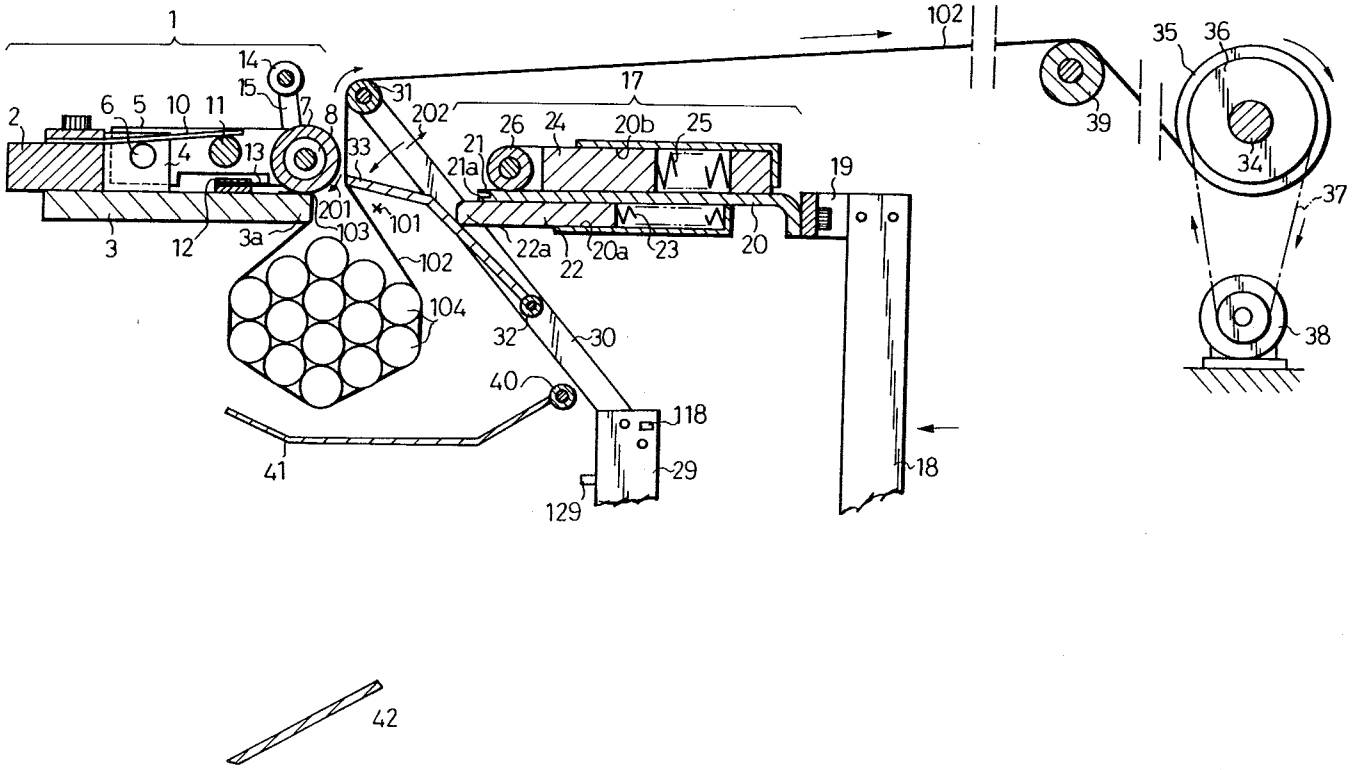

Since the other set of movable levers 18 only move further without interruption, the presser plate 33 is pushed downward (in the direction opposite to that of the arrow 202) by the movable seal plate 22 of the movable-side seal cutting assembly 17 in opposition to the urging force applied thereto and comes into contact with the packaging film 102 as shown in FIG. 5. In synchronization with the above action the electric motor 38 is energized so as to rotate backward, the packaging film 102 is pulled back onto the take-up roll 35, and the articles 104 bound by the packaging film 102 is lifted up. On the other hand, the movable seal plate 22 of the movable-side seal cutting assembly 17 is moving continuously while passing over the presser plate 33, and the presser plate 33 is tilted further downward to press the articles 104; thus, the articles 104 are prevented from moving upward. At this time, since the electric motor 38 is rotating continuously backward, the packaging film 102 is pulled backward to bind tightly the articles 104.

Figure 6:
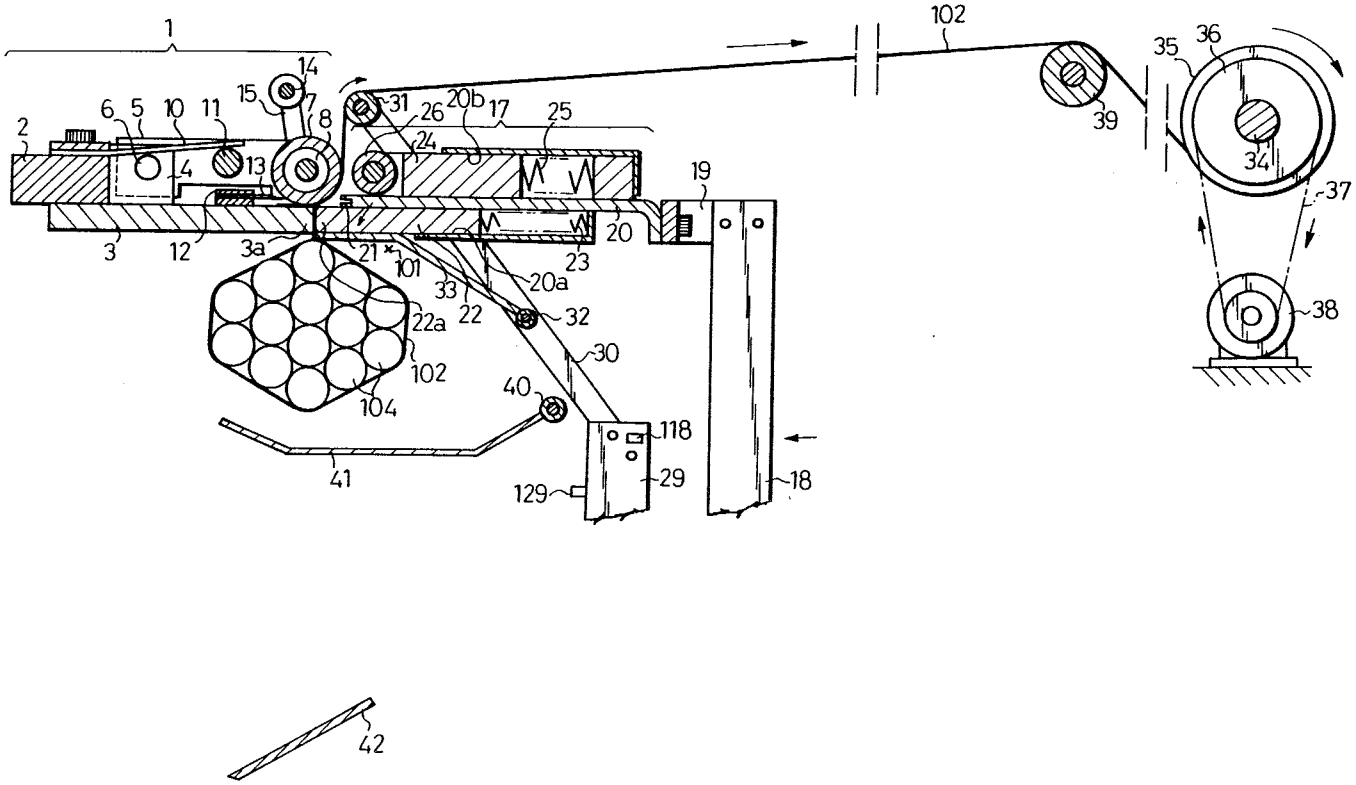
Figure 7:
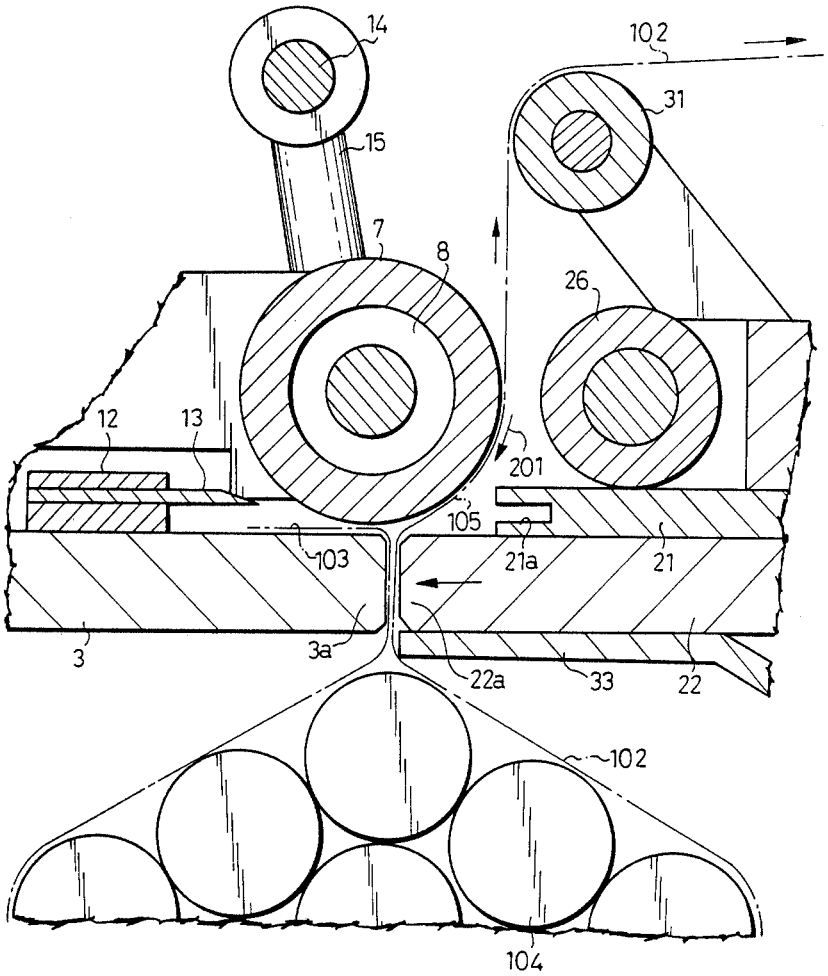
FIG. 7 is a fragmentary enlarged sectional view corresponding to that of FIG. 6.

Then, as the movable seal plate 22 of the movable-side seal cutting assembly 17 abuts on the fixed seal plate 3 of the fixed-side seal cutting assembly 1 as shown in FIGS. 6 through 8, one end 103 and the other coupling end 105 of the packaging film 102 are pinched together by the pinching portions 3*a* and 22*a* of these plates. Up to the time of this pinching action, the electric motor 38 is rotated reversely, the action of pulling back the packaging film 102 is continued, and binding tightly the articles 104 takes place.

As the movable levers 18 move further, while keeping the contacted state with the fixed seal plate 3 of the fixed-side seal cutting assembly 1 the movable seal plate 22 of the movable-side seal cutting assembly 17 plunges into the accommodation chamber 20*a* in opposition to the urging force of the compression coil spring 23, and with a little delay from the abutment between the fixed seal plate 3 and the movable seal plate 22, the movable-side pinching roller 26 of the movable-side seal cutting assembly 17 comes into abutment on the fixed-side pinching roller 7 of the fixed-side seal cutting assembly 1 in opposition to the urging force applied thereto, as a result, between these rollers is pinched the coupling end 105 of the packaging film 102. In synchronization with this pinching action, the inclined coupling surfaces 27*a* of both guide levers 27 of the movable-side seal cutting assembly 17 abut on the corresponding coupling rollers 9 of the fixed-side seal cutting assembly 1, as a result, both the guide levers 27 lift up both the coupling rollers 9 as well as the fixed-side pinching roller 7 in opposition to the urging force of the leaf springs 10, the pushing-in portion 21 of the movable-side seal cutting assembly 17 eats into between the pinching portion 3*a* of the fixed seal plate 3 and the fixed-side pinching roller 7, and the movable-side seal cutting assembly 17 stops when the movable levers 18 abut on the stoppers 118. In the thus attained state, the coupling end 105 of the packaging film 102 is bent by the pushing-in portion 21 into the shape of a "U", one end 103 and the coupling end 105 of the packaging film 102 are interposed in the mutually-piled state with some looseness between the pinching portion 3*a* of the fixed seal plate 3 and the pushing-in portion 21, and the coupling end 105 of the packaging film 102 is pinched between the fixed-side pinching roller 7 and the pushing-in portion 21. One end 103 and the coupling end 105 of the packaging film 102 pinched in the mutually-piled state between the pinching portion 3*a* of the fixed seal plate 3 and the pinching portion 22*a* of the movable seal plate 22 are fusion-bonded together under the pinched condition by means of the heat of the fixed seal plate 3 equipped with the heater.

Figure 13:
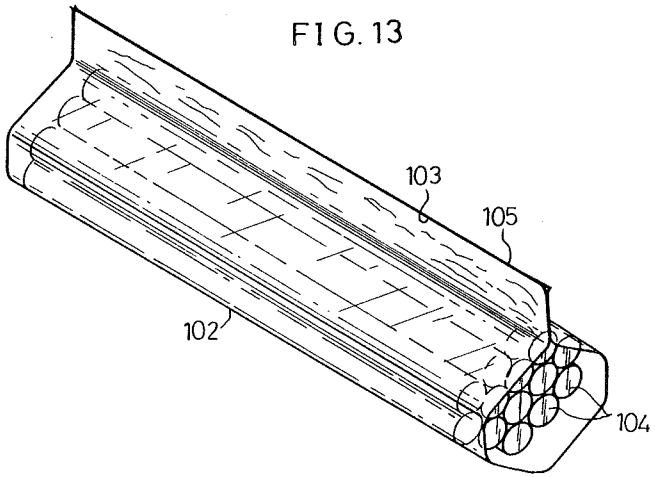
FIG. 13 is a perspective view showing articles barrel-bound and packaged.

Then, as shown in FIGS. 11 and 12, in response to rotation of the rotary shaft 14, the rods 15 tilt and the slide plate 12 comes close to the pushing-in portion 21, so that the saw blade 13 is inserted in the cutting groove 21*a* of the pushing-in portion 21 and the coupling end 105 of the packaging film 102 is cut off thereat. Before this cutting action, the receiving plate 41 has been tilted down to realize continuity with the ejecting plate 42. At the time of cutting, the lower end of each rod 15 abuts on the corresponding coupling pin 28 of the movable seal plate 22, the movable seal plate 22 plunges into the accommodation chamber 20*a* in opposition to the urging force of the compression coil spring 23, the pinching portion 22*a* of the movable seal plate 22 separates a little from the pinching portion 3*a* of the fixed seal plate 3, and as shown in FIG. 13, the articles 104 thus barrel-bound and packaged fall onto the ejecting plate 42 owing to its own weight.

After completion of packaging, both the movable levers 18 and 29 move in the manner completely reverse to the foregoing manner of operation, and the movable-side seal cutting assembly 17, guide roller 31, and presser plate 33 return to their respective initial states of operation shown in FIG. 14.

Although the packaging film is used in the embodiment described above, the present invention can be applied to a system utilizing a tape in lieu of the film. In this case, either and portion of the articles is bound by the tape. Further, the saw blade 13 of the foregoing embodiment may be made movable with respect to the fixed seal plate 3 and the cutting groove 21*a* of the pushing-in portion 21 may be made to be pressed against this saw blade 13.

As many different modifications may be made without departing from the spirit and scope of the present invention, it is not intended to have the present invention limited to the specific embodiment thereof, except as defined in the appended claims.

What is claimed is:

1. An article barrel-binding and packaging method comprising the steps of (a) pinching one end of packaging material in a pinching region between a fixed seal member and a fixed-side pinching member capable of approaching and separating from said fixed seal member;

(b) pinching one end and a coupling end of said packaging material in the mutually-piled state between said fixed seal member and a movable seal member confronting said fixed seal member facing one side of said pinching region while keeping the articles in the bound state by said packaging material and pinching the coupling end of said packaging material between said fixed-side pinching member and a movable-side pinching member confronting said fixed-side pinching member from said one side of said pinching region;

(c) in substantial synchronization with the preceding step, inserting a pushing-in member between said fixed seal member and said fixed-side pinching member from said one side of said pinching region in response to separation of said fixed-side pinching member and pinching one end and the coupling end, thus bent by said pushing-in member, of said packaging material in the mutually-piled and interposed state between said fixed seal member and said pushing-in member;

(d) joining together one end and the coupling end of said packaging material between said fixed and said movable seal members while they are being pinched between both said seal members and thereafter cutting the coupling end of said packaging material by a cutting blade on said fixed seal member confronting the side of said pinching region opposite said one side at the inserted end of said pushing-in member; and (e) separating said fixed and movable seal members and said fixed-side and movable side pinching members from each other individually, pulling out said pushing-in member from between said fixed seal member and said fixed side pinching member, and pinching again one end of said packaging material between the first-mentioned seal member and pinching member.

2. An article barrel-binding and packaging device comprising (a) a fixed-side seal cutting assembly comprising a fixed seal member, a fixed-side pinching member movably mounted to approach and separate from said fixed seal member for pinching one end of packaging material in a pinching region therebetween, and a cutting blade supported on said fixed seal member facing one side of said pinching region between said fixed seal member and said fixed-side pinching member;

(b) a movable-side seal cutting assembly movable mounted to approach and separate from said fixed-side seal cutting assembly from the other side of said pinching region opposite said one side, comprising a pushing-in member mounted to pass between said fixed seal member and said fixed-side pinching member and come close to said cutting blade at the time of approaching said fixed-side seal cutting assembly, said pushing-in member being positioned to cooperate with said cutting member at the time of cutting said packaging material to cut packaging material therebetween, a movable seal member mounted to be relatively movable with respect to said pushing-in member to abut said fixed seal member in substantial synchronization with the movement of said pushing-in member toward said fixed side seal cutting assembly, and a movable-side pinching member mounted to be relatively movable with respect to said pushing-in member to abut said fixed-side pinching member in substantial synchronization with said movement of said pushing-in member; and (c) a take-up roll for taking up said packaging material.

3. An article barrel-binding and packaging device according to claim 2, wherein said fixed-side pinching member is a pinching roller having a clutch for preventing said fixed-side pinching member from rotating in the direction of pulling out said packaging material when one end of said packaging material is pinched between said fixed-side pinching member and said fixed seal member.

4. An article barrel-binding and packaging device according to claim 3, wherein said fixed-side seal cutting assembly includes further a fixed base for supporting said fixed seal member, a pair of supporting portions attached on said fixed base, and a pair of arms supported vertically tiltably above said fixed seal member with respect to said supporting portions, said arms supporting said fixed-side pinching roller between their points.

5. An article barrel-binding and packaging device according to claim 4, including further a pair of leaf springs attached on said fixed base, and a coupling lever stretched between both said arms in the space between said fixed base and said pinching roller, whereby as said coupling lever is urged as the result of both said leaf springs coming into engagement with said coupling lever, said pinching roller is pressed against said fixed seal member.

6. An article barrel-binding and packaging device according to claim 5, including further a slide member placed on said fixed seal member, and a saw blade attached to said slide member, which extends along said pinching roller in the lengthwise direction thereof and confronts the abutting portions of said fixed seal member and said pinching roller.

7. An article barrel-binding and packaging device according to claim 6, including further a rotary shaft provided above said pinching roller in substantially parallel therewith, a pair of rods attached to said rotary shaft and extending downward therefrom, and a pair of angle levers secured to said respective rods, the lower ends of both said angle levers coupling with said slide member.

8. An article barrel-binding and packaging device according to claim 2, wherein said movable-side seal cutting assembly includes further a base plate for supporting the whole assembly, said base plate being supported by a pair of movable levers positioned on the widthwisely-spaced sides of said movable-side seal cutting assembly.

9. An article barrel-binding and packaging device according to claim 8, wherein said base plate has in its point a cutting groove extending in the lengthwise direction of said movable pinching member, in which groove said cutting blade is to be inserted.

10. An article barrel-binding and packaging device according to claim 9, including further a supporting member provided on said base plate for supporting at its point said movable-side pinching member, and compression springs for urging said seal member and said supporting member individually toward said fixed-side seal cutting assembly, whereby said seal member and said supporting member are movable in their respective lengthwise directions when pressed by said fixed-side seal cutting assembly.

11. An article barrel-binding and packaging device according to claim 10, including further a pair of coupling rollers attached to the respective outsides of the points of both said arms, and a pair of guide levers attached to the respective widthwisely-spaced sides of said base plate and confronting said corresponding coupling rollers, wherein said guide levers function so as to lift up both said guide rollers and said fixed-side pinching member as inclined coupling surfaces provided on their points abut on said corresponding guide rollers.

12. An article barrel-binding and packaging device according to claim 2, including further a pair of movable levers provided below said movable-side seal cutting assembly, a pair of supporting levers secured to the ends of both said movable levers so as to extend obliquely toward said fixed-side seal cutting assembly, and a guide roller stretched between the upper ends of both said supporting levers for supporting said packaging material from below.

13. An article barrel-binding and packaging device according to claim 12, wherein both said supporting levers hold a presser member attached pivotably at its base end to a portion thereof for pressing said packaging material by its point.

14. An article barrel-binding and packaging device according to claim 13, including further a receiving member provided at a position below the space between said fixed-side seal cutting assembly and said movable-side seal cutting assembly for receiving the articles having been packaged, which is tiltable downward, and an ejecting member provided below said receiving member for ejecting the articles dropped from said receiving member.

* * * * *